US009978386B2

(12) United States Patent
Liu

(10) Patent No.: US 9,978,386 B2
(45) Date of Patent: May 22, 2018

(54) VOICE PROCESSING METHOD AND DEVICE

(71) Applicant: TENCENT TECHNOLOGY (SHENZHEN) COMPANY LIMITED, Shenzhen, Guangdong (CN)

(72) Inventor: Hong Liu, Guangdong (CN)

(73) Assignee: Tencent Technology (Shenzhen) Company Limited, Shenzhen (CN)

( * ) Notice: Subject to any disclaimer, the term of this patent is extended or adjusted under 35 U.S.C. 154(b) by 0 days. days.

(21) Appl. No.: 15/174,321

(22) Filed: Jun. 6, 2016

(65) Prior Publication Data

US 2016/0284358 A1 Sep. 29, 2016

Related U.S. Application Data

(63) Continuation of application No. PCT/CN2015/072099, filed on Feb. 2, 2015.

(51) Int. Cl.

| | |
|---|---|
| ***G10L 19/16*** | (2013.01) |
| ***G10L 19/22*** | (2013.01) |
| ***G10L 21/034*** | (2013.01) |
| ***G10L 21/0208*** | (2013.01) |
| ***G10L 25/93*** | (2013.01) |

(52) U.S. Cl.

CPC ..... *G10L 19/167* (2013.01); *G10L 19/22* (2013.01); *G10L 21/034* (2013.01); *G10L 2021/02082* (2013.01); *G10L 2025/932* (2013.01)

(58) Field of Classification Search

CPC ..... G10L 19/18; G10L 19/002

See application file for complete search history.

(56) References Cited

U.S. PATENT DOCUMENTS 5,619,566 A * 4/1997 Fogel ..... G10L 25/78 379/406.07

6,782,361 B1 * 8/2004 El-Maleh ..... G10L 19/012 704/223

(Continued)

FOREIGN PATENT DOCUMENTS

CN 1980293 A 6/2007

CN 101166377 A 4/2008

(Continued)

OTHER PUBLICATIONS

International Search Report with translation and Written Opinion of the ISA for PCT/CN2015/072099, ISA/CN, Haidian District, Beijing, dated Apr. 28, 2015.

(Continued)

*Primary Examiner* — Brian L Albertalli

(74) *Attorney, Agent, or Firm* — Brinks Gilson & Lione

(57) ABSTRACT

A voice processing method and device, the method comprising: detecting a current voice application scenario in a network (S1); determining the voice quality requirement and the network requirement of the current voice application scenario (S2); based on the voice quality requirement and the network requirement, configuring voice processing parameters corresponding to the voice application scenario (S3); and according to the voice processing parameters, conducting voice processing on the voice signals collected in the voice application scenario (S4).

20 Claims, 4 Drawing Sheets

(56) References Cited

U.S. PATENT DOCUMENTS

2002/0072919 A1* 6/2002 Yokoyama ..... G10L 19/012 704/278
2007/0129037 A1 6/2007 Lian et al.
2008/0147388 A1* 6/2008 Singh ..... G10L 15/1822 704/226
2008/0147411 A1 6/2008 Dames et al.
2009/0006104 A1* 1/2009 Sung ..... G10L 19/22 704/500
2009/0325704 A1* 12/2009 Tom ..... A63F 13/10 463/39
2010/0088092 A1* 4/2010 Bruhn ..... G10L 19/26 704/228
2011/0044200 A1* 2/2011 Kulyk ..... G10L 25/69 370/252
2012/0046940 A1* 2/2012 Tsujikawa ..... G10L 21/0272 704/200
2012/0166188 A1* 6/2012 Chakra ..... G10L 15/26 704/226
2012/0195370 A1 8/2012 Guerrero
2013/0144617 A1* 6/2013 Murakami ..... H04M 3/42314 704/226
2013/0182866 A1* 7/2013 Kobayashi ..... G10K 11/175 381/73.1
2014/0095155 A1 4/2014 Ren

FOREIGN PATENT DOCUMENTS

CN 101237489 A 8/2008
CN 101320563 A 12/2008
CN 101719962 A 6/2010
CN 102014205 A 4/2011
CN 103219011 A 7/2013
CN 103617797 A 3/2014
CN 103716437 A 4/2014
JP 2006081051 A * 3/2006 ..... H04M 1/6016
JP 2009130499 A 6/2009
WO WO 2010079967 A2 * 7/2010 ..... H04L 1/0014

OTHER PUBLICATIONS

First Chinese Office Action regarding Application No. 201310661273.6 dated Jul. 10, 2015. English translation provided by EPO Global Dossier.
Second Chinese Office Action regarding Application No. 201310661273.6 dated Jan. 28, 2016. English translation provided by EPO Global Dossier.

* cited by examiner

VOICE PROCESSING METHOD AND DEVICE

CROSS REFERENCE TO RELATED APPLICATION

The application is a continuation of International Application No. PCT/CN2015/072099, filed on Feb. 2, 2015, which claims priority to Chinese Patent Application 201310661273.6, titled "VOICE PROCESSING METHOD AND DEVICE", filed on Dec. 9, 2013 with the State Intellectual Property Office of the People's Republic of China, both of which are incorporated herein by reference.

TECHNICAL FIELD

The present disclosure relates to the field of information technology, and in particular to a method and a device for processing a voice.

BACKGROUND

With the popularization of voice communication over Internet, voice communication is becoming an indispensable part of user's daily life. For example, conversations in an online chat room or during a game and live broadcasting of a voice on a network all relate to the technology of network voice communication.

To achieve a network voice communication, the following process is to be performed at a side of a voice acquisition device.

1. Voice signals are acquired. This step is to acquire the voice of a user. The voice signal may be acquired via a device such as a microphone.

2. Digital signal processing (DSP) is performed on the voice signal to obtain an encoded voice packet. This step is to process the acquired voice signal, which may include echo cancellation, noise suppress and so on.

In a case that multiple channels of voice signals are acquired, a voice mixing process may be performed before obtaining the encoded voice packet. Other processing about sound effect may also be performed on the voice before obtaining the encoded voice packet.

3. The obtained encoded voice packet is transmitted to a receiving end of the voice.

At present, voice streams are processed with a uniform processing method for different application scenarios. Hence, in a scenario which has a high requirement on voice quality, the requirement on the voice quality can not be met; and in a scenario which has a low requirement on voice quality, resources are wasted since a lot of system resources are occupied. As a result, the current solution in which the voice streams are processed with a uniform processing method can not be adapted to current voice requirements of multiple scenarios.

SUMMARY

In view of the above, a method and a device for processing a voice are provided according to embodiments of the present disclosure, to provide a solution for processing a voice based on an application scenario of the voice, so as to enable the solution for processing the voice to be adapted to the application scenario of the voice.

A method for processing a voice, which is applied to a network, includes:

detecting a current application scenario of the voice in the network;

determining a requirement of the current application scenario of the voice on voice quality and a requirement of the current application scenario of the voice on the network;

configuring a voice processing parameter corresponding to the application scenario of the voice, based on the determined requirement on the voice quality and the determined requirement on the network; and performing voice processing on a voice signal acquired in the application scenario of the voice, based on the voice processing parameter.

A device for processing a voice, which is applied to a network, includes:

a detecting unit, configured to detect a current application scenario of the voice in the network;

a determining unit, configured to determine a requirement of the current application scenario of the voice on voice quality and a requirement of the current application scenario of the voice on the network;

a parameter configuring unit, configured to configure a voice processing parameter corresponding to the application scenario of the voice detected by the detecting unit, based on the determined requirement on the voice quality and the determined requirement on the network; and a voice processing unit, configured to perform voice processing on a voice signal acquired in the application scenario of the voice, based on the voice processing parameter configured by the parameter configuring unit.

It can be seen from the above technical solutions that, application scenarios of the voice which have different requirements on voice quality correspond to different voice processing parameters, and the voice processing parameter adapted to the current application scenario of the voice is determined. By performing a voice processing with the voice processing parameter adapted to the current application scenario of the voice, the solution for processing the voice can be adapted to the current application scenario of the voice, therefore, system resources are saved while the requirement on the voice quality is met.

BRIEF DESCRIPTION OF THE DRAWINGS

In order to more clearly illustrate technical solutions of embodiments of the present disclosure, drawings used in the description of the embodiments are introduced briefly hereinafter. Apparently, the drawings described in the following only illustrate some embodiments of the present disclosure, and other drawings may be obtained by those ordinarily skilled in the art based on these drawings without any creative efforts.

DETAILED DESCRIPTION OF THE EMBODIMENTS

In order to make the object, the technical solutions, and the advantages of the present disclosure clearer, the present disclosure is described in detail hereinafter, in conjunction with the drawings. Apparently, the described embodiments are only a few but not all of embodiments of the present invention. All other embodiments obtained by those ordinarily skilled in the art based on the embodiments of the present disclosure without any creative efforts fall within the protection scope of the present disclosure.

The voice herein broadly includes audio frequencies of voices produced by a vocal organ and audio frequencies of silence in the interval between the voices. For example, the voice may be voices produced by both sides of a call and silence between the voices, or may be audio frequencies including voices and background voices of an environment of the voices. As another example, the voice may be audio frequencies of a concert including silence of voices.

The application scenario of the voice herein refers to a scenario involving the voice, such as a call, a chat or a performance.

Figure 1A:
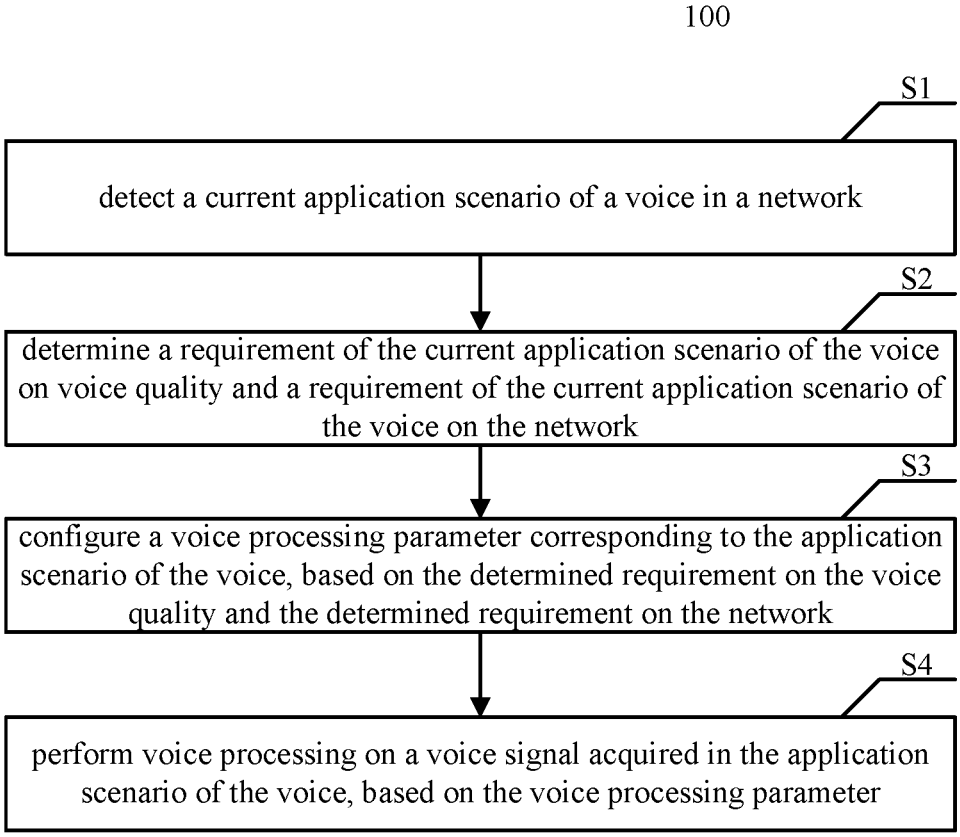
FIG. 1A is a schematic flow chart of a method according to an embodiment of the present disclosure.

Reference is made to FIG. 1A. A method 100 for processing a voice is provided according to an embodiment of the present disclosure. The method is applied to a network. The method includes:

a step S1 of detecting a current application scenario of the voice in the network;

a step S2 of determining a requirement of the current application scenario of the voice on voice quality and a requirement of the current application scenario of the voice on the network;

a step S3 of configuring a voice processing parameter corresponding to the application scenario of the voice, based on the determined requirement on the voice quality and the determined requirement on the network; and a step S4 of performing voice processing on a voice signal acquired in the application scenario of the voice, based on the voice processing parameter.

According to an embodiment, the application scenario of the voice includes: a network game scenario, a talk scenario, a high quality without network video talk scenario, a high quality with network live broadcast scenario or a high quality with network video talk scenario, a super quality with network live broadcast scenario or a super quality with network video talk scenario.

According to an embodiment, the requirement on the network includes a requirement on a network speed, a requirement on uplink and downlink bandwidths of the network, a requirement on network traffic or a requirement on a network delay.

According to various embodiments, the voice processing parameter may include: at least one of a voice sample rate, an enable or disable state of acoustic echo cancellation, an enable or disable state of noise suppress, a noise attenuation intensity, an enable or disable state of automatic gain control, an enable or disable state of voice activity detection, the number of silence frames, a coding rate, a coding complexity, an enable or disable state of forward error correction, a network packet mode and a network packet transmitting mode.

Figure 1B:
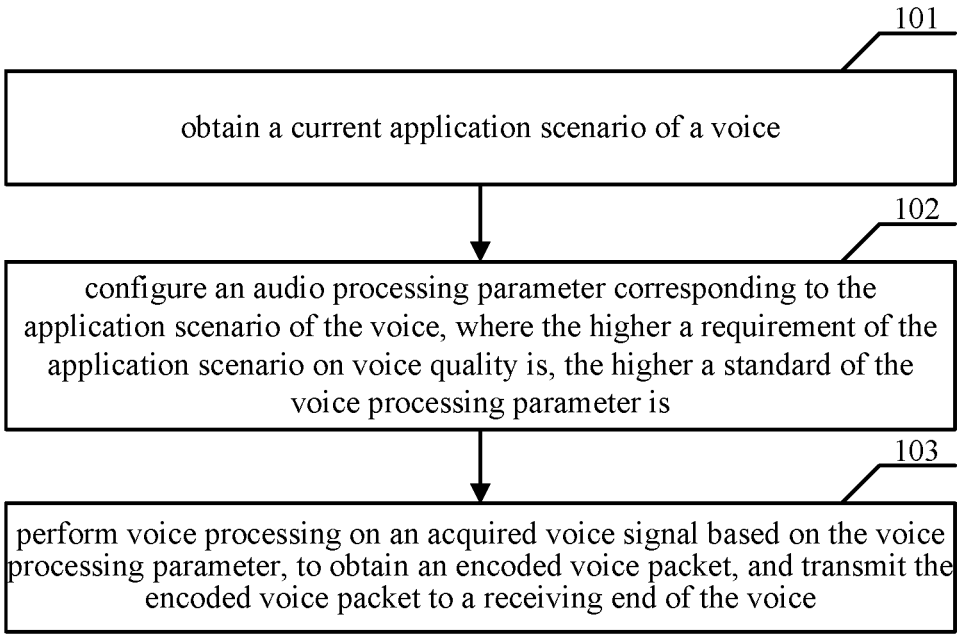
FIG. 1B is a schematic flow chart of a method according to an embodiment of the present disclosure.

As shown in FIG. 1B, a method for processing a voice is provided according to an embodiment of the present disclosure, which includes steps 101 to 103.

In step 101, a current application scenario of the voice is detected.

The process of detecting the scenario may be an automatic detection process performed by an apparatus, or may be setting of a scenario mode performed by a user. The specific method for obtaining the application scenario of the voice does not affect the implementation of the embodiment of the present disclosure, and thus it is not limited herein.

The application scenario of the voice refers to the current application scenario for the voice processing. Hence, the application scenario of the voice may be various application scenarios in the field of computer technology to which the voice may be applied nowadays. It can be known by those skilled in the art that there are many application scenarios to which the voice can be applied nowadays, which can not be exhaustively listed in the embodiment of the present disclosure. Several representative application scenarios of the voice are illustrated in the embodiment of the present disclosure. Optionally, the above application scenario of the voice includes: at least one of a game scenario (Game Talk Mode, GTM, also referred to as a talk mode in a game scenario), a talk scenario (Normal Talk Mode, NTM, also referred to as a normal talk mode), a high quality without video talk scenario (High Quality Mode, HQM, also referred to as a no video talk mode in a high quality scenario), a high quality with live broadcast scenario or a high quality with video talk scenario (High Quality with Video Mode, HQVM, also referred to as a high quality with live broadcast mode or a video talk mode in a high quality scenario), and a super quality with live broadcast scenario or a super quality with video talk scenario (Super Quality with Video Mode, SQV, also referred to as a live broadcast mode in a super quality scenario or a video talk mode in a super quality scenario).

Different application scenarios of the voice have different requirements on voice quality. For example, the game scenario has a low requirement on voice quality but a high requirement on currently occupied network speed, and requires less CPU (Central Processor Unit) resources for voice processing. The scenario relating live broadcast requires high fidelity and requires a special sound effect processing. A high quality mode requires more CPU resources and network traffic to ensure that the voice quality meets a requirement of the user.

In step 102, a voice processing parameter corresponding to the application scenario of the voice is configured. The higher the requirement of the application scenario on the voice quality is, the higher a standard of the voice processing parameter is.

The voice processing parameter is a guidance standard parameter for determining how to perform voice processing. It can be known by those skilled in the art that there may be many options for controlling the voice processing. A variation in system resources occupied by the voice processing which is caused by the various possible options can be predicted by those skilled in the art. A variation in voice quality which is caused by the various voice processing is also can be predicted by those skilled in the art. Based on the requirements of each application scenario on voice quality and on resource consumption, those skilled in the art can determine how to select the voice processing parameter.

After the application scenario of the voice is obtained, the corresponding voice processing parameter is determined. The voice processing parameter may be pre-set locally. For example, the voice processing parameter may be stored in a form of a configuration table, which may be implemented as follows. Optionally, voice processing parameters corresponding to various application scenarios of the voice are pre-set in a device for processing the voice, and the various application scenarios of the voice correspond to different voice quality. The process of configuring the voice processing parameter corresponding to the application scenario of the voice includes: configuring the voice processing parameter corresponding to the application scenario of the voice based on pre-set voice processing parameters corresponding to various application scenarios of the voice.

It can be known by those skilled in the art that there may be many options for controlling the voice processing. A variation in system resources occupied by the voice processing which is caused by the various possible options can be predicted by those skilled in the art. A variation in voice quality which is caused by the various voice processing also can be predicted. In the embodiment of the present disclosure, the voice processing parameter preferably used for controlling decision is illustrated in the following. Optionally, the voice processing parameter includes: at least one of a voice sample rate, an enable or disable state of acoustic echo cancellation, an enable or disable state of noise suppress (NS), a noise attenuation intensity, an enable or disable state of automatic gain control (AGC), an enable or disable state of voice activity detection, the number of silence frames, a coding rate, a coding complexity, an enable or disable state of forward error correction, a network packet mode and a network packet transmitting mode.

A variation in system resources occupied by the voice processing which is caused by the selection of parameter states of the voice processing parameters illustrated above can be predicted by those skilled in the art. A variation in voice quality which is caused by the various voice processing also can be predicted. Based on the various application scenarios illustrated in the above embodiments, a preferred solution for setting is provided according to an embodiment of the present disclosure, which is described as follows: the higher the requirement of the application scenario on the voice quality is, the higher the standard of the voice processing parameter is, including:

the voice processing parameter for the game scenario is set as: the acoustic echo cancellation is enabled, the noise suppress is enabled, the noise attenuation intensity is high, the automatic gain control is enabled, the voice activity detection is enabled, the number of silence frames is large, the coding rate is low, the coding complexity is high, the forward error correction is enabled, the network packet mode is packing two voice frames in one encoded voice packet, and the network packet transmitting mode is single transmission;

the voice processing parameter for the talk scenario is set as: the acoustic echo cancellation is enabled, the noise suppress is enabled, the noise attenuation intensity is low, the automatic gain control is enabled, the voice activity detection is enabled, the number of silence frames is small, the coding rate is low, the coding complexity is high, the forward error correction is enabled, the network packet mode is packing three voice frames in one encoded voice packet, and the network packet transmitting mode is single transmission;

the voice processing parameter for the high quality without video talk scenario is set as: the acoustic echo cancellation is enabled, the noise suppress is enabled, the noise attenuation intensity is low, the automatic gain control is enabled, the voice activity detection is enabled, the number of silence frames is small, the coding rate is a default value, the coding complexity is a default value, the forward error correction is enabled, the network packet mode is packing one voice frame in one encoded voice packet, and the network packet transmitting mode is single transmission;

the voice processing parameter for the high quality with live broadcast scenario or high quality with video talk scenario is set as: the acoustic echo cancellation is disabled, the noise suppress is disabled, the automatic gain control is disabled, the voice activity detection is disabled, the coding rate is a default value, the coding complexity is a default value, the forward error correction is enabled, the network packet mode is packing one voice frame in one encoded voice packet, and the network packet transmitting mode is double transmission;

the voice processing parameter for the super quality with live broadcast scenario or super quality with video talk scenario is set as: the acoustic echo cancellation is disabled, the noise suppress is disabled, the automatic gain control is disabled, the voice activity detection is disabled, the coding rate is high, the coding complexity is a default value, the forward error correction is disabled, the network packet mode is packing one voice frame in one encoded voice packet, and the network packet transmitting mode is single transmission.

For controlling of the voice sample rate, the voice sample rate may be influenced by controlling the number of channels. In the embodiment of the present disclosure, the so-called multichannel includes two or more channels. The specific number of the channels is not limited in the embodiment of the disclosure. A preferred solution for setting the voice sample rate for different application scenarios is described as follows. Optionally, the voice sample rate for the game scenario and the talk scenario is set to be a single-channel, a low sample rate and a low bit rate. The voice sample rate for the high quality without video talk scenario, the high quality with live broadcast scenario or high quality with video talk scenario, and the super quality with live broadcast scenario or super quality with video talk scenario is set to be a multichannel, a high sample rate and a high bit rate. The high bit rate is a bit rate higher than the low bit rate.

In step 103, voice processing is performed on an acquired voice signal based on the voice processing parameter, to obtain an encoded voice packet. The encoded voice packet is transmitted to a receiving end of the voice.

In the above embodiments, the application scenarios of the voice which have different requirements on the voice quality correspond to different voice processing parameters, and a voice processing parameter adapted to the current application scenario of the voice is determined. An encoded voice packet is obtained by performing voice processing with the voice processing parameter adapted to the current application scenario of the voice, in this way, the solution of voice processing is adapt to the current application scenario of the voice, and thus system resources are saved while the requirement on the voice quality is met.

For the process of performing voice processing on the acquired voice signal to obtain the encoded voice packet, a control parameter may be selected based on different requirements. Different control parameters correspond to different control flows. An optional solution is provided according to an embodiment of the present disclosure. It can be known by those skilled in the art that optional solutions are not exhaustively illustrated by the following examples, and the following examples should not be interpreted as limitation to the embodiments of the present disclosure.

Optionally, the process of performing voice processing on the acquired voice signal to obtain the encoded voice packet includes the follows.

In a case that a background voice is currently enabled, it is determined whether the acquired voice signal is a voice inputted via a microphone. If the acquired voice signal is the voice inputted via the microphone, digital signal processing is performed on a voice stream inputted via the microphone, and after the digital signal processing is finished, voice mixing with the background voice, voice encoding and packing are performed to obtain the encoded voice packet. If the acquired voice signal is not the voice inputted via the microphone, voice mixing, voice encoding and packing are performed after the voice is acquired, to obtain the encoded voice packet.

In a case that a background voice is not currently enabled, digital signal processing is performed on the acquired voice signal, to obtain a voice frame. Voice activity detection is performed on the obtained voice frame to determine whether the obtained voice frame is a silence frame. Voice encoding and packing are performed on a non-silence frame, to obtain the encoded voice packet.

Optionally, the digital signal processing includes at least one of voice signal pre-processing, echo cancellation, noise suppress and automatic gain control.

In the following embodiments, specific application scenarios of the embodiments of the present disclosure are illustrated in more detail.

Voice designers are confronted with a problem of voice communication in different scenarios, such as a game talk scenario, a normal talk scenario, a high quality talk scenario, a high quality with live broadcast scenario (a normal video mode), or a super quality with live broadcast scenario (which is mainly used for concerts). Since different scenarios have different requirements on parameters such as voice quality and sound effect, CPU efficiency, and uplink and downlink traffic, a voice engine algorithm is designed based on a specific scenario, to meet different user requirements. However, in conventional voice communication software, these application scenarios are not differentiated, and a voice stream is processed using a uniform processing method, which will result in the following problems in the above application scenarios. Firstly, in the game mode scenario, the requirement on voice quality is not high, and it is required that there is no game lag. Therefore, if processing is performed without differentiating, too much CPU overhead and too much uplink and downlink traffic overhead may be caused, which will affect game experience. Secondly, in the high quality mode scenario, if processing is performed in a manner of the normal talk mode, voice quality will not meet the user requirement. Thirdly, in a concert, music with high fidelity is required, and special sound effect processing is also required. Based on the above technical problems, different voice processing methods are designed for different application scenarios according to the embodiments of the present disclosure, to realize reasonable utilization of resources while the requirement of each scenario on effect is met.

Figure 2:
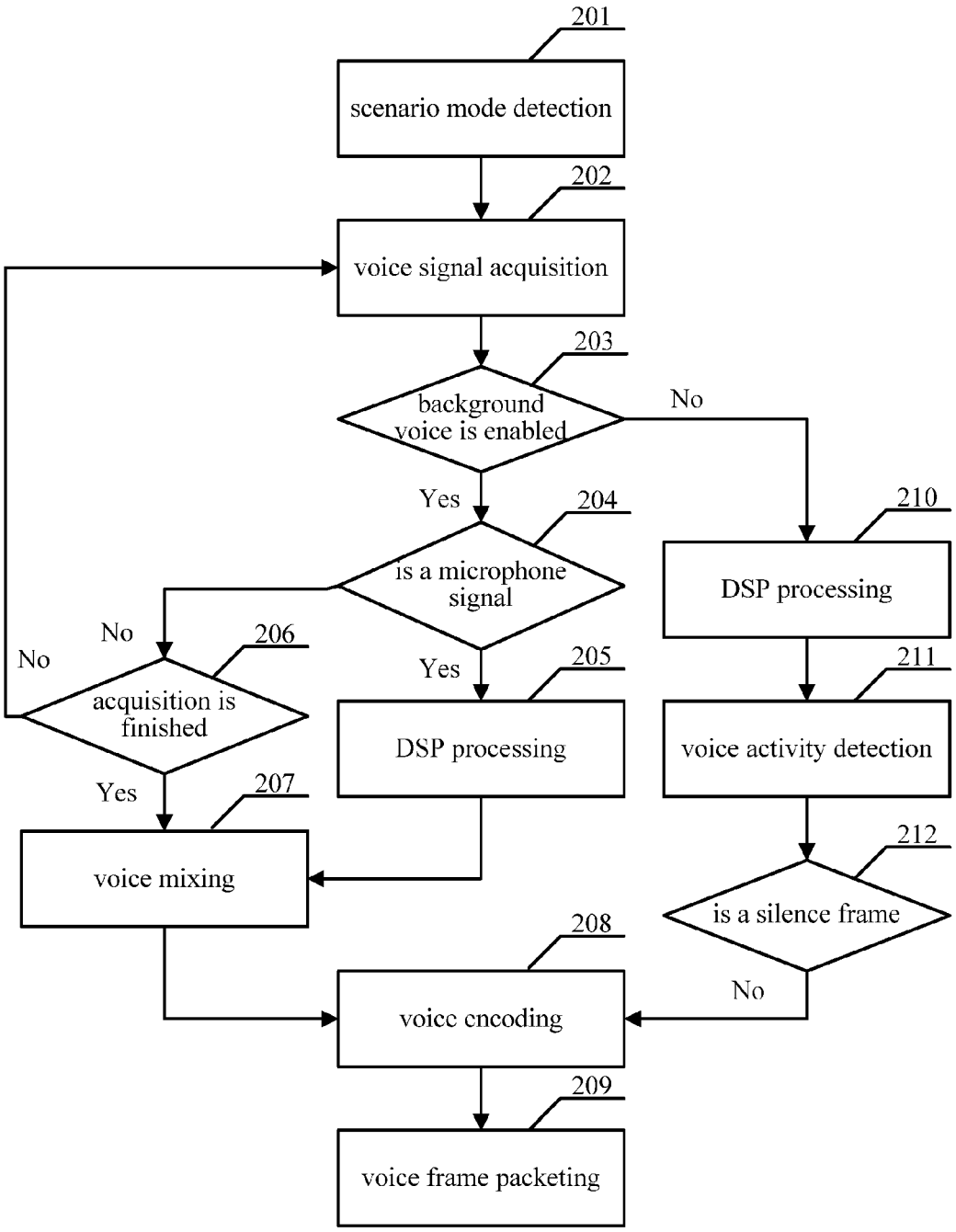
FIG. 2 is a schematic flow chart of a method according to an embodiment of the present disclosure.

A specific process of a transmitting end based on voice engine technology for multiple scenarios is illustrated in FIG. 2. FIG. 2 is a general block diagram. Each of the steps is optional (that is, the step may not be performed) for different modes. Reference is made to mode configuration table 1 for parameters to be used in the steps illustrated in FIG. 2.

In step 201, scenario detection is performed, to determine a current application scenario of the voice.

In the step, the scenario detection is to detect the application scenario of the voice. Mainly five scenarios are illustrated in the embodiment of the present disclosure, i.e., a normal talk scenario, a game talk scenario, a high quality talk scenario, a high quality with live broadcast scenario and a super quality with live broadcast scenario.

In step 202, a voice signal is acquired.

For a voice processing end, the voice signal may be acquired via a microphone.

An acquisition thread is started in the step. Voice acquisition is performed based on engine configuration. For the normal talk scenario and the game talk scenario, a single-channel and a low sample rate are utilized. For the other application scenarios, a dual-channel and a high sample rate are utilized.

In step 203, it is determined whether a background voice is enabled. In a case that the background is enabled, the process goes to step 204. In a case that the background voice is not enabled, the process goes to step 210.

In some application scenarios, there is a background voice, such as an accompaniment in a concert. In some application scenarios, there is no background voice, such as a scenario of voice talk.

In step 204, it is determined whether it is a signal inputted via the microphone. In a case that it is the signal inputted via the microphone, the process goes to step 205. In a case that it is not the signal inputted via the microphone, the process goes to step 206.

The step is to determine a source of the voice.

In step 205, DSP processing is performed.

A specific processing flow of DSP is described in detail in subsequent embodiments.

In step 206, it is determined whether acquisition of voice data is finished. In a case that the acquisition of the voice data is finished, the process goes to step 207. In a case that the acquisition of the voice data is not finished, the process goes to step 202.

For a solution in which the voice is acquired via the microphone, the step is to determine whether the acquisition of the voice data on all channels of the microphone is finished.

In step 207, voice mixing processing is performed.

In the step, voice mixing is performed on the background voice and the voice from the microphone. In addition, the voice mixing may not be performed in the step, but performed on an opposite end, that is, a receiving end of the encoded voice packet. For example, in a chat room scenario, the background voice received by the receiving end of each encoded voice packet may be identical, that is, the background voice is also on the receiving end of the encoded voice packet; in this case, voice mixing may be performed on the receiving end of the encoded voice packet.

In step 208, voice encoding is performed.

The step is to compress the voice signal on which the voice mixing processing has been performed, to save traffic. An encoding module may select an optimum algorithms based on different application scenarios. In the game mode or the normal talk mode, FEC (Forward Error Correction) is usually enabled, which reduces uplink and downlink traffic and improves an ability to prevent packet loss. In the game mode or the normal talk mode, an encoder with a low bit rate and a low complexity is usually selected. In the high quality mode, an encoder with a high bit rate and a high complexity is selected. Reference may be made to Table 1 for configuring a voice encoding parameter.

In step 209, a voice frame is packed, to obtain an encoded voice packet. After the packing is finished, the encoded voice packet may be transmitted to the receiving end corresponding to the encoded voice packet.

In the step, different packet lengths and packing methods may be selected based on different scenarios. Reference is made to Table 1 for specific parameter controlling.

In step 210, DSP processing is performed.

In step 211, voice activity detection (Voice active detect, VAD) is performed.

In step 212, it is determined whether the current frame is a silence frame based on the voice activity detection performed in step 211. In a case that the current frame is a silence frame, the current frame may be discarded. In a case that the current frame is not a silence frame, the process goes to step 208 for voice encoding.

TABLE 1 configuration information table of voice engine algorithm for application scenarios of voice

| | AEC | NS | AGC | VAD | Codec | pack mode | send mode |
|---|---|---|---|---|---|---|---|
| NTM | on | on att = low | on | on agg = low | br = low com = high fec = on | 3frames/ packet | single transmission |
| GTM | on | on att = high | on | on agg = high | br = low com = low fec = on | 2frames/ packet | single transmission |
| HQM | on | on att = low | on | on agg = low | br = def com = def fec = on | 1frame/ packet | single transmission |
| HQVM | off | off | off | off | br = def com = def fec = on | 1frame/ packet | double transmission |
| SQVM | off | off | off | off | br = high com = def fec = off | 1frame/ packet | single transmission |

note:

1. on represents that a module is enabled, and off represents that a module is disabled;
2. att is an abbreviation of attenuate, high represents that noise attenuation is high, and low represents that noise attenuation is low;
3. agg is an abbreviation of aggressive, high represents that more silence frames are generated, and low represents that less silence frames are generated;
4. com is an abbreviation of complicity, high represents complicity is high, and voice quality is better at the same bit rate;
5. br is an abbreviation of bits rate, low represents a low bit rate, high represents a high bit rate, and def represents a default bit rate;
6. fec represents an encoding mode with forward error correction, and an ability to prevent packet loss is greatly improved after fec is enabled;
7. pack mode represents a network packet mode, and there are three modes at present, i.e., packing three voice frames in one packet, packing two voice frames in one packet, and packing one voice frame in one packet;
8. Send mode represents a network packet transmitting mode, single transmission represents that each network packet is transmitted for only one time, and double transmission represents that each network packet is transmitted for two times.

Figure 3:
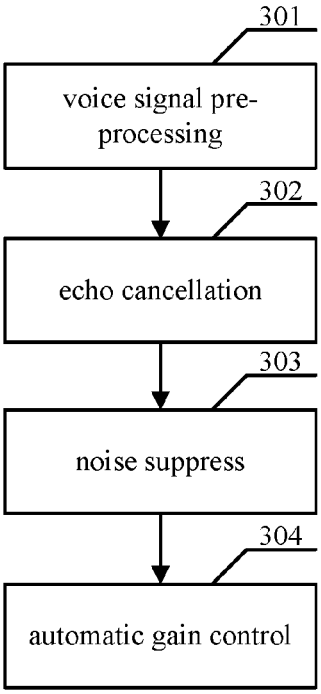
FIG. 3 is a schematic flow chart of a method according to an embodiment of the present disclosure.

A flow chart of a DSP algorithm is shown in FIG. 3, which includes steps 301 to 304.

In step 301, a voice signal is pre-processed. The step is to pre-process a voice signal acquired via a microphone. The pre-process mainly includes direct current isolation filtering and high-pass filtering, to filter out related direct current noise and ultralow frequency noise, which makes subsequent signal processing more stable.

In step 302, echo cancellation is performed. The step is to perform echo cancellation on the pre-processed signal, to offset an echo signal acquired via the microphone.

In step 303, noise suppress is preformed. After the noise suppress (NS) is performed on the signal outputted from an echo processor, a signal-to-noise ratio and a recognition accuracy of the voice signal are improved.

In step 304, automatic gain control is performed. After a signal on which the noise suppress has been performed passes through an automatic gain control module, the voice signal becomes more smooth.

It can be obtained from experiments that, by adopting the above solutions, CPU occupation and uplink and downlink traffic can be greatly reduced in the game mode, and voice quality is greatly improved in the super quality with video mode. Therefore, the solution for processing the voice based on the application scenario of the voice provided above makes the voice processing solution adapted to the application scenario of the voice, and thus system resources are saved while the requirement on the voice quality is met.

Figure 4A:
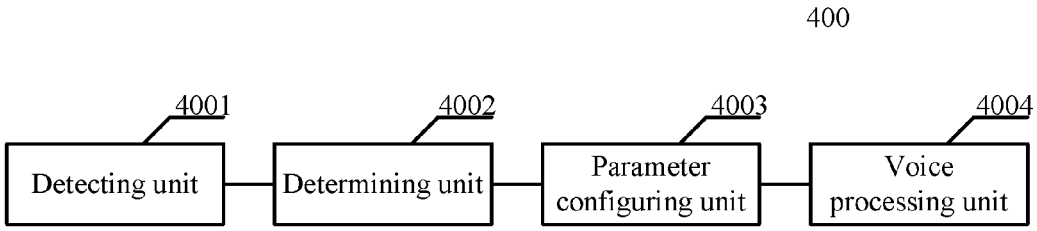
FIG. 4A is a schematic structural diagram of a device according to an embodiment of the present disclosure.

Reference is made to FIG. 4A. A device 400 for processing a voice is provided according to an embodiment of the present disclosure. The device is applied to a network and includes:

a detecting unit 4001, configured to detect a current application scenario of the voice in the network;

a determining unit 4002, configured to determine a requirement of the current application scenario of the voice on voice quality and a requirement of the current application scenario of the voice on the network;

a parameter configuring unit 4003, configured to configure a voice processing parameter corresponding to the application scenario of the voice detected by the detecting unit, based on the determined requirement on the voice quality and the determined requirement on the network; and a voice processing unit 4004, configured to perform voice processing on a voice signal acquired in the application scenario of the voice, based on the voice processing parameter configured by the parameter configuring unit.

Figure 4B:
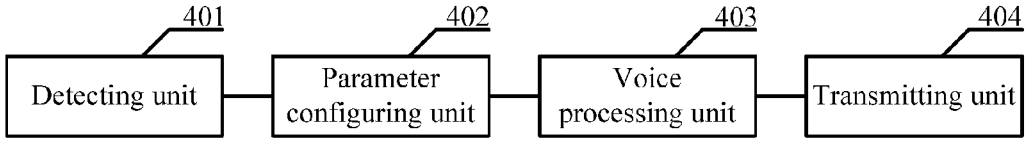
FIG. 4B is a schematic structural diagram of a device according to an embodiment of the present disclosure.

As shown in FIG. 4B, a device for processing a voice is provided, which includes:

a detecting unit 401, configured to detect a current application scenario of the voice;

a parameter configuring unit 402, configured to configure a voice processing parameter corresponding to the application scenario of the voice obtained by the detecting unit 401; the higher a requirement of the application scenario on voice quality is, the higher a standard of the voice processing parameter is;

a voice processing unit 403, configured to perform voice processing on an acquired voice signal, based on the voice processing parameter configured by the parameter configuring unit 402, to obtain an encoded voice packet; and a transmitting unit 404, configured to transmit the encoded voice packet obtained by the voice processing unit 403 to a receiving end of the voice.

The process of detecting the scenario may be an automatic detection process performed by an apparatus, or may be setting of a scenario mode performed by a user. The specific method for obtaining the application scenario of the voice does not affect the implementation of the embodiment of the present disclosure, and thus it is not limited herein.

The voice processing parameter is a guidance standard parameter for determining how to perform voice processing. It can be known by those skilled in the art that there may be many options for controlling the voice processing. A variation in system resources occupied by the voice processing which is caused by the various possible options can be predicted by those skilled in the art. A variation in voice quality which is caused by the various voice processing is also can be predicted by those skilled in the art. Based on the requirements of each application scenario on voice quality and on resource consumption, those skilled in the art can determine how to select the voice processing parameter.

In the above embodiments, the application scenarios of the voice which have different requirements on the voice quality correspond to different voice processing parameters, and a voice processing parameter adapted to the current application scenario of the voice is determined. An encoded voice packet is obtained by performing voice processing with the voice processing parameter adapted to the current application scenario of the voice, in this way, the solution of voice processing is adapt to the current application scenario of the voice, and thus system resources are saved while the requirement on the voice quality is met.

After the application scenario of the voice is obtained, the corresponding voice processing parameter is determined. The voice processing parameter may be pre-set locally. For example, the voice processing parameter may be stored in a form of a configuration table, which may be implemented as follows. Optionally, voice processing parameters corresponding to various application scenarios of the voice are pre-set in a device for processing the voice, and the various application scenarios of the voice correspond to different voice quality.

The parameter configuring unit 402 is configured to configure the voice processing parameter corresponding to the application scenario of the voice based on pre-set voice processing parameters corresponding to various application scenarios of the voice.

It can be known by those skilled in the art that there may be many options for controlling the voice processing. A variation in system resources occupied by the voice processing which is caused by the various possible options can be predicted by those skilled in the art. A variation in voice quality which is caused by the various voice processing also can be predicted. In the embodiment of the present disclosure, the voice processing parameter preferably used for controlling decision is illustrated in the following. Optionally, the voice processing parameter configured by the parameter configuring unit 402 includes: at least one of a voice sample rate, an enable or disable state of acoustic echo cancellation, an enable or disable state of noise suppress, a noise attenuation intensity, an enable or disable state of automatic gain control, an enable or disable state of voice activity detection, the number of silence frames, a coding rate, a coding complexity, an enable or disable state of forward error correction, a network packet mode and a network packet transmitting mode.

For the process of performing voice processing on the acquired voice signal to obtain the encoded voice packet, a control parameter may be selected based on different requirements. Different control parameters correspond to different control flows. An optional solution is provided according to an embodiment of the present disclosure. It can be known by those skilled in the art that optional solutions are not exhaustively illustrated by the following examples, and the following examples should not be interpreted as limitation to the embodiments of the present disclosure. Optionally, the voice processing unit 403 is configured to:

in a case that a background voice is currently enabled, determine whether the acquired voice signal is a voice inputted via a microphone; if the acquired voice signal is the voice inputted via the microphone, perform digital signal processing on a voice stream inputted via the microphone; and after the digital signal processing performed is finished, perform voice mixing with the background voice, voice encoding and packing to obtain the encoded voice packet; if the acquired voice signal is not the voice inputted via the microphone, perform voice mixing, voice encoding and packing after the voice is acquired, to obtain the encoded voice packet; and in a case that a background voice is not currently enabled, perform digital signal processing on the acquired voice signal, to obtain a voice frame; perform voice activity detection on the obtained voice frame to determine whether the obtained voice frame is a silence frame; and perform voice encoding and packing on a non-silence frame to obtain the encoded voice packet.

Optionally, the voice processing unit 403 is configured to perform the digital signal processing, including at least one of voice signal pre-processing, echo cancellation, noise suppress and automatic gain control.

The application scenario of the voice refers to the current application scenario for the voice processing. Hence, the application scenario of the voice may be various application scenarios in the field of computer technology to which the voice may be applied nowadays. It can be known by those skilled in the art that there are many application scenarios to which the voice can be applied nowadays, which can not be exhaustively listed in the embodiment of the present disclosure. Several representative application scenarios of the voice are illustrated in the embodiment of the present disclosure. Optionally, the above application scenario of the voice obtained by the detecting unit 401 includes: at least one of a game scenario, a talk scenario, a high quality without video talk scenario, a high quality with live broadcast scenario or a high quality with video talk scenario, and a super quality with live broadcast scenario or a super quality with video talk scenario.

Different application scenarios of the voice have different requirements on voice quality. For example, the game scenario has a low requirement on voice quality but a high requirement on currently occupied network speed, and requires less CPU (Central Processor Unit) resources for voice processing. The scenario relating live broadcast requires high fidelity and requires a special sound effect processing. A high quality mode requires more CPU resources and network traffic to ensure that the voice quality meets a requirement of the user.

A variation in system resources occupied by the voice processing which is caused by the selection of parameter states of the voice processing parameters illustrated above can be predicted by those skilled in the art. A variation in voice quality which is caused by the various voice processing also can be predicted. Based on the various application scenarios illustrated in the above embodiments, a preferred solution for setting is provided according to an embodiment of the present disclosure. Specifically, the voice processing parameter configured by the parameter configuring unit 402 includes: the voice processing parameter for the game scenario being set as: the acoustic echo cancellation is enabled, the noise suppress is enabled, the noise attenuation intensity is high, the automatic gain control is enabled, the voice activity detection is enabled, the number of silence frames is large, the coding rate is low, the coding complexity is high, the forward error correction is enabled, the network packet mode is packing two voice frames in one encoded voice packet, and the network packet transmitting mode is single transmission;

the voice processing parameter for the talk scenario being set as: the acoustic echo cancellation is enabled, the noise suppress is enabled, the noise attenuation intensity is low, the automatic gain control is enabled, the voice activity detection is enabled, the number of silence frames is small, the coding rate is low, the coding complexity is high, the forward error correction is enabled, the network packet mode is packing three voice frames in one encoded voice packet, and the network packet transmitting mode is single transmission;

the voice processing parameter for the high quality without video talk scenario being set as: the acoustic echo cancellation is enabled, the noise suppress is enabled, the noise attenuation intensity is low, the automatic gain control is enabled, the voice activity detection is enabled, the number of silence frames is small, the coding rate is a default value, the coding complexity is a default value, the forward error correction is enabled, the network packet mode is packing one voice frame in one encoded voice packet, and the network packet transmitting mode is single transmission;

the voice processing parameter for the high quality with live broadcast scenario or high quality with video talk scenario being set as: the acoustic echo cancellation is disabled, the noise suppress is disabled, the automatic gain control is disabled, the voice activity detection is disabled, the coding rate is a default value, the coding complexity is a default value, the forward error correction is enabled, the network packet mode is packing one voice frame in one encoded voice packet, and the network packet transmitting mode is double transmission; and the voice processing parameter for the super quality with live broadcast scenario or super quality with video talk scenario being set as: the acoustic echo cancellation is disabled, the noise suppress is disabled, the automatic gain control is disabled, the voice activity detection is disabled, the coding rate is high, the coding complexity is a default value, the forward error correction is disabled, the network packet mode is packing one voice frame in one encoded voice packet, and the network packet transmitting mode is single transmission.

For controlling of the voice sample rate, the voice sample rate may be influenced by controlling the number of channels. In the embodiment of the present disclosure, the so-called multichannel includes two or more channels. The specific number of the channels is not limited in the embodiment of the disclosure. A preferred solution for setting the voice sample rate for different application scenarios is described as follows. Optionally, the voice processing parameter configured by the parameter configuring unit 402 includes: the voice sample rate for the game scenario and the talk scenario being set to be a single-channel and a low sample rate, and the voice sample rate for the high quality without video talk scenario, the high quality with live broadcast scenario or high quality with video talk scenario, and the super quality with live broadcast scenario or super quality with video talk scenario being set to be a multichannel and a high sample rate.

Figure 5:
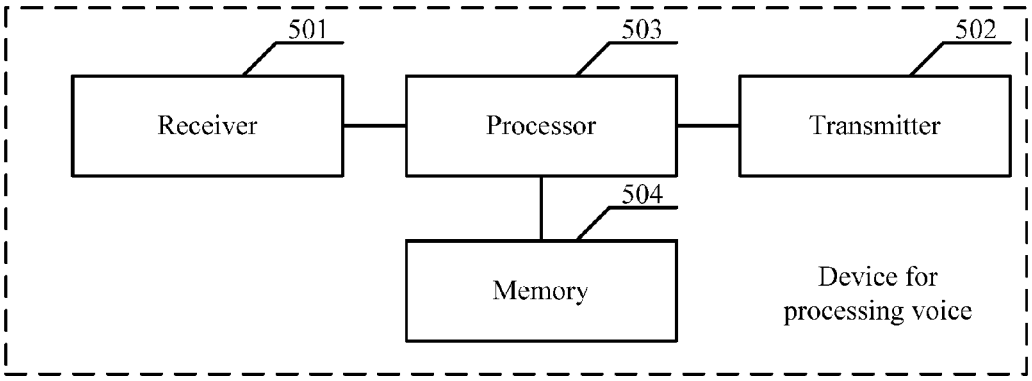
FIG. 5 is a schematic structural diagram of a device according to an embodiment of the present disclosure.

As shown in FIG. 5, another device for processing a voice is provided according to an embodiment of the present disclosure, which includes: a receiver 501, a transmitter 502, a processor 503 and a memory 504.

The processor 503 is configured to: detect a current application scenario of the voice; configure a voice processing parameter corresponding to the application scenario of the voice, where the higher a requirement of the application scenario on voice quality is, the higher a standard of the voice processing parameter is; perform voice processing on an acquired voice signal based on the voice processing parameter, to obtain an encoded voice packet; and transmit the encoded voice packet to a receiving end of the voice.

The process of detecting the scenario may be an automatic detection process performed by an apparatus, or may be setting of a scenario mode performed by a user. The specific method for obtaining the application scenario of the voice does not affect the implementation of the embodiment of the present disclosure, and thus it is not limited herein.

The voice processing parameter is a guidance standard parameter for determining how to perform voice processing. It can be known by those skilled in the art that there may be many options for controlling the voice processing. A variation in system resources occupied by the voice processing which is caused by the various possible options can be predicted by those skilled in the art. A variation in voice quality which is caused by the various voice processing is also can be predicted by those skilled in the art. Based on the requirements of each application scenario on voice quality and on resource consumption, those skilled in the art can determine how to select the voice processing parameter.

In the above embodiments, the application scenarios of the voice which have different requirements on the voice quality correspond to different voice processing parameters, and a voice processing parameter adapted to the current application scenario of the voice is determined. An encoded voice packet is obtained by performing voice processing with the voice processing parameter adapted to the current application scenario of the voice, in this way, the solution of voice processing is adapt to the current application scenario of the voice, and thus system resources are saved while the requirement on the voice quality is met.

After the application scenario of the voice is obtained, the corresponding voice processing parameter is determined. The voice processing parameter may be pre-set locally. For example, the voice processing parameter may be stored in a form of a configuration table, which may be implemented as follows. Optionally, voice processing parameters corresponding to various application scenarios of the voice are pre-set in a device for processing the voice, and the various application scenarios of the voice correspond to different voice quality. The processor 503 being configured to configure a voice processing parameter corresponding to the application scenario of the voice includes: configuring the voice processing parameter corresponding to the application scenario of the voice based on pre-set voice processing parameters corresponding to various application scenarios of the voice.

It can be known by those skilled in the art that there may be many options for controlling the voice processing. A variation in system resources occupied by the voice processing which is caused by the various possible options can be predicted by those skilled in the art. A variation in voice quality which is caused by the various voice processing also can be predicted. In the embodiment of the present disclosure, the voice processing parameter preferably used for controlling decision is illustrated in the following. Optionally, the voice processing parameter configured by the processor 503 includes: at least one of a voice sample rate, an enable or disable state of acoustic echo cancellation, an enable or disable state of noise suppress, a noise attenuation intensity, an enable or disable state of automatic gain control, an enable or disable state of voice activity detection, the number of silence frames, a coding rate, a coding complexity, an enable or disable state of forward error correction, a network packet mode and a network packet transmitting mode.

For the process of performing voice processing on the acquired voice signal to obtain the encoded voice packet, a control parameter may be selected based on different requirements. Different control parameters correspond to different control flows. An optional solution is provided according to an embodiment of the present disclosure. It can be known by those skilled in the art that optional solutions are not exhaustively illustrated by the following examples, and the following examples should not be interpreted as limitation to the embodiments of the present disclosure. Optionally, the processor 503 being configured to perform voice processing on the acquired voice signal to obtain the encoded voice packet includes:

in a case that a background voice is currently enabled, determining whether the acquired voice signal is a voice inputted via a microphone; if the acquired voice signal is the voice inputted via the microphone, performing digital signal processing on a voice stream inputted via the microphone; and after the digital signal processing is finished, performing voice mixing with the background voice, voice encoding and packing to obtain the encoded voice packet; if the acquired voice signal is not the voice inputted via the microphone, performing voice mixing, voice encoding and packing after the voice is acquired, to obtain the encoded voice packet; and in a case that a background voice is not currently enabled, performing digital signal processing on the acquired voice signal, to obtain a voice frame; performing voice activity detection on the obtained voice frame to determine whether the obtained voice frame is a silence frame; and performing voice encoding and packing on a non-silence frame to obtain the encoded voice packet.

Optionally, the processor 503 is configured to perform the digital signal processing, including at least one of voice signal pre-processing, echo cancellation, noise suppress and automatic gain control.

The application scenario of the voice refers to the current application scenario for the voice processing. Hence, the application scenario of the voice may be various application scenarios in the field of computer technology to which the voice may be applied nowadays. It can be known by those skilled in the art that there are many application scenarios to which the voice can be applied nowadays, which can not be exhaustively listed in the embodiment of the present disclosure. Several representative application scenarios of the voice are illustrated in the embodiment of the present disclosure. Optionally, the above application scenario of the voice includes: at least one of a game scenario, a talk scenario, a high quality without video talk scenario, a high quality with live broadcast scenario or a high quality with video talk scenario, and a super quality with live broadcast scenario or a super quality with video talk scenario. Different application scenarios of the voice have different requirements on voice quality. For example, the game scenario has a low requirement on voice quality but a high requirement on currently occupied network speed, and requires less CPU (Central Processor Unit) resources for voice processing. The scenario relating live broadcast requires high fidelity and requires a special sound effect processing. A high quality mode requires more CPU resources and network traffic to ensure that the voice quality meets a requirement of the user. A variation in system resources occupied by the voice processing which is caused by the selection of parameter states of the voice processing parameters illustrated above can be predicted by those skilled in the art. A variation in voice quality which is caused by the various voice processing also can be predicted. Based on the various application scenarios illustrated in the above embodiments, a preferred solution for setting is provided according to an embodiment of the present disclosure. Specifically, the processor 503 being configured to: set the voice processing parameter for the game scenario as: the acoustic echo cancellation is enabled, the noise suppress is enabled, the noise attenuation intensity is high, the automatic gain control is enabled, the voice activity detection is enabled, the number of silence frames is large, the coding rate is low, the coding complexity is high, the forward error correction is enabled, the network packet mode is packing two voice frames in one encoded voice packet, and the network packet transmitting mode is single transmission;

set the voice processing parameter for the talk scenario as: the acoustic echo cancellation is enabled, the noise suppress is enabled, the noise attenuation intensity is low, the automatic gain control is enabled, the voice activity detection is enabled, the number of silence frames is small, the coding rate is low, the coding complexity is high, the forward error correction is enabled, the network packet mode is packing three voice frames in one encoded voice packet, and the network packet transmitting mode is single transmission;

set the voice processing parameter for the high quality without video talk scenario as follows: the acoustic echo cancellation is enabled, the noise suppress is enabled, the noise attenuation intensity is low, the automatic gain control is enabled, the voice activity detection is enabled, the number of silence frames is small, the coding rate is a default value, the coding complexity is a default value, the forward error correction is enabled, the network packet mode is packing one voice frame in one encoded voice packet, and the network packet transmitting mode is single transmission;

set the voice processing parameter for the high quality with live broadcast scenario or high quality with video talk scenario as follows: the acoustic echo cancellation is disabled, the noise suppress is disabled, the automatic gain control is disabled, the voice activity detection is disabled, the coding rate is a default value, the coding complexity is a default value, the forward error correction is enabled, the network packet mode is packing one voice frame in one encoded voice packet, and the network packet transmitting mode is double transmission; and set the voice processing parameter for the super quality with live broadcast scenario or super quality with video talk scenario as follows: the acoustic echo cancellation is disabled, the noise suppress is disabled, the automatic gain control is disabled, the voice activity detection is disabled, the coding rate is high, the coding complexity is a default value, the forward error correction is disabled, the network packet mode is packing one voice frame in one encoded voice packet, and the network packet transmitting mode is single transmission.

For controlling of the voice sample rate, the voice sample rate may be influenced by controlling the number of channels. In the embodiment of the present disclosure, the so-called multichannel includes two or more channels. The specific number of the channels is not limited in the embodiment of the disclosure. A preferred solution for setting the voice sample rate for different application scenarios is described as follows. Optionally, processor 503 is configured to set the voice sample rate for the game scenario and the talk scenario to be a single-channel and a low sample rate, and set the voice sample rate for the high quality without video talk scenario, the high quality with live broadcast scenario or high quality with video talk scenario, and the super quality with live broadcast scenario or super quality with video talk scenario to be a multichannel and a high sample rate.

Figure 6:
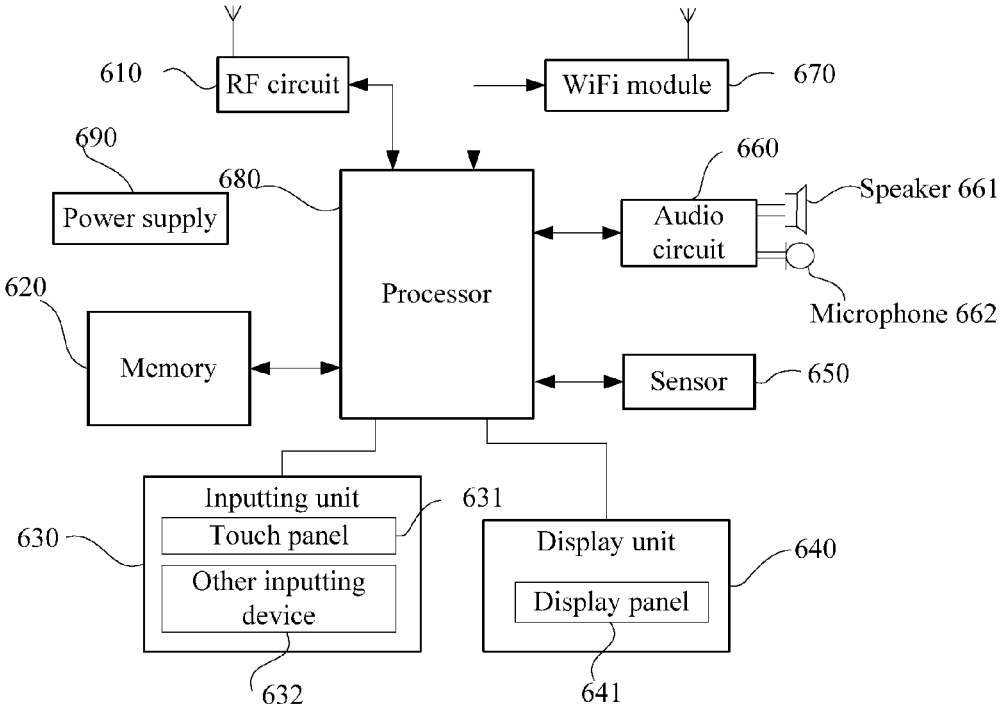
FIG. 6 is a schematic structural diagram of a terminal according to an embodiment of the present disclosure.

As shown in FIG. 6, another device for processing a voice is provided according to an embodiment of the present disclosure. In order to facilitate illustration, only parts related to the embodiments of the present disclosure are illustrated, and for the technical details, reference is made to the method embodiments of the present disclosure. A terminal may be any terminal device such as a mobile phone, a tablet computer, a PDA (Personal Digital Assistant), a POS (Point of Sales) and an onboard computer. A case in which the terminal is a mobile phone is taken as an example.

FIG. 6 is a block diagram of part of structure of a mobile phone which is related to a terminal provided according to an embodiment of the present disclosure. Reference is made to FIG. 6, the mobile phone includes: a radio frequency (RF) circuit 610, a memory 620, an inputting unit 630, a display unit 640, a sensor 650, an audio circuit 660, a wireless fidelity (WiFi) module 670, a processor 680, a power supply 690 and so on. It can be understood by those skilled in the art that, the structure of the mobile phone illustrated in FIG. 6 does not limit the mobile phone. Compared with components illustrated in the FIG. 6, more or less components may be included, or some components may be combined, or components may be differently arranged.

In conjunction with FIG. 6, each of components of the mobile phone is described in detail.

The RF circuit 610 may be configured to receive and send information, or to receive and send signals in a call. Specifically, the RF circuit delivers the downlink information received from a base station to the processor 680 for processing, and transmits designed uplink data to the base station. Generally, the RF circuit 610 includes but not limited to an antenna, at least one amplifier, a transceiver, a coupler, a Low Noise Amplifier (LNA), and a duplexer. In addition, the RF circuit 610 may communicate with other devices and network via wireless communication. The wireless communication may use any communication standard or protocol, including but not limited to Global System of Mobile communication (GSM), General Packet Radio Service (GPRS), Code Division Multiple Access (CDMA), Wideband Code Division Multiple Access (WCDMA), Long Term Evolution (LTE), E-mail, and Short Messaging Service (SMS).

The memory 620 may be configured to store software programs and modules, and the processor 680 may execute various function applications and data processing of the mobile phone by running the software programs and modules stored in the memory 620. The memory 620 may mainly include a program storage area and a data storage area. The program storage area may be used to store, for example, an operating system and an application required by at least one function (for example, a voice playing function, an image playing function). The data storage area may be used to store, for example, data established according to the use of the mobile phone (for example, audio data, telephone book). In addition, the memory 620 may include a high-speed random access memory and a nonvolatile memory, such as at least one magnetic disk memory, a flash memory, or other volatile solid-state memory.

The inputting unit 630 may be configured to receive input numeric or character information, and to generate a key signal input related to user setting and function control of the mobile phone. Specifically, the input unit 630 may include a touch control panel 631 and other input device 632. The touch control panel 631 is also referred to as a touch screen which may collect a touch operation thereon or thereby (for example, an operation on or around the touch control panel 631 that is made by a user with a finger, a touch pen and any other suitable object or accessory), and drive corresponding connection devices according to a pre-set procedure. Optionally, the touch control panel 631 may include a touch detection device and a touch controller. The touch detection device detects touch orientation of a user, detects a signal generated by the touch operation, and transmits the signal to the touch controller. The touch controller receives touch information from the touch detection device, converts the touch information into touch coordinates and transmits the touch coordinates to the processor 680. The touch controller also can receive a command from the processor 680 and execute the command. In addition, the touch control panel 631 may be implemented by, for example, a resistive panel, a capacitive panel, an infrared panel and a surface acoustic wave panel. In addition to the touch control panel 631, the input unit 630 may also include other input device 632. Specifically, the other input device 632 may include but not limited to one or more of a physical keyboard, a function key (such as a volume control button, a switch button), a trackball, a mouse and a joystick.

The display unit 640 may be configured to display information input by a user or information provided to the user and various menus of the mobile phone. The display unit 640 may include a display panel 641. Optionally, the display panel 641 may be formed in a form of a Liquid Crystal Display (LCD), an Organic Light-Emitting Diode (OLED) or the like. In addition, the display panel 641 may be covered by the touch control panel 631. When the touch control panel 631 detects a touch operation thereon or thereby, the touch control panel 631 transmits the touch operation to the processor 680 to determine the type of the touch event, and then the processor 680 provides a corresponding visual output on the display panel 641 according to the type of the touch event. Although the touch control panel 631 and the display panel 641 implement the input and output functions of the mobile phone as two separate components in FIG. 6, the touch control panel 631 and the display panel 641 may be integrated together to implement the input and output functions of the mobile phone in other embodiment.

The mobile phone may further include at least one sensor 650, such as an optical sensor, a motion sensor and other sensors. The optical sensor may include an ambient light sensor and a proximity sensor. The ambient light sensor may adjust the luminance of the display panel 641 according to the intensity of ambient light, and the proximity sensor may close the backlight or the display panel 641 when the mobile phone is approaching to the ear. As a kind of motion sensor, a gravity acceleration sensor may detect the magnitude of acceleration in multiple directions (usually three-axis directions) and detect the value and direction of the gravity when the sensor is in the stationary state. The acceleration sensor may be applied in, for example, an application of mobile phone pose recognition (for example, switching between landscape and portrait, a correlated game, magnetometer pose calibration), a function about vibration recognition (for example, a pedometer, knocking). Other sensors such as a gyroscope, a barometer, a hygrometer, a thermometer, an infrared sensor, which may be further provided in the mobile phone, are not described herein.

The audio circuit 660, a loudspeaker 661 and a microphone 662 may provide an audio interface between the user and the terminal. The audio circuit 660 may transmit an electric signal, converted from received audio data, to the loudspeaker 661, and a voice signal is converted from the electric signal and then outputted by the loudspeaker 661. The microphone 662 converts captured voice signal into an electric signal, the electric signal is received by the audio circuit 660 and converted into audio data. The audio data is outputted to the processor 680 for processing and then sent to another mobile phone via the RF circuit 610; or the audio data is outputted to the memory 620 for further processing.

WiFi is a short-range wireless transmission technique. The mobile phone may help the user to, for example, send and receive E-mail, browse a webpage and access a streaming media via the WiFi module 670, and provide wireless broadband Internet access for the user. Although the WiFi module 670 is shown in FIG. 6, it can be understood that the WiFi module 670 is not necessary for the mobile phone, and may be omitted as needed within the scope of the essence of the disclosure.

The processor 680 is a control center of the mobile phone, which connects various parts of the mobile phone by using various interfaces and wires, and implements various functions and data processing of the mobile phone by running or executing the software programs and/or modules stored in the memory 620 and invoking data stored in the memory 620, thereby monitoring the mobile phone as a whole. Optionally, the processor 680 may include one or more processing cores. Preferably, an application processor and a modem processor may be integrated into the processor 680. The application processor is mainly used to process, for example, an operating system, a user interface and an application. The modem processor is mainly used to process wireless communication. It can be understood that, the above modem processor may not be integrated into the processor 680.

The mobile phone also includes the power supply 690 (such as a battery) for powering various components. Preferably, the power supply may be logically connected with the processor 680 via a power management system, therefore, functions such as charging, discharging and power management are implemented by the power management system.

Although not shown, the mobile phone may also include a camera, a Bluetooth module and so on, which are not described herein.

According to an embodiment of the present disclosure, the processor 680 may execute instructions in the memory 620, to perform the following operations:

detecting a current application scenario of a voice in a network;

determining a requirement of the current application scenario of the voice on voice quality and a requirement of the current application scenario of the voice on the network;

configuring a voice processing parameter corresponding to the application scenario of the voice, based on the determined requirement on the voice quality and the determined requirement on the network; and performing voice processing on a voice signal acquired in the application scenario of the voice, based on the voice processing parameter.

In an embodiment of the present disclosure, the processor 680 included in the terminal may also have the following functions.

The processor 680 is configured to: detect a current application scenario of a voice; configure a voice processing parameter corresponding to the application scenario of the voice, where the higher a requirement of the application scenario on voice quality is, the higher a standard of the voice processing parameter is; perform voice processing on an acquired voice signal based on the voice processing parameter, to obtain an encoded voice packet; and transmit the encoded voice packet to a receiving end of the voice.

The process of detecting the scenario may be an automatic detection process performed by an apparatus, or may be setting of a scenario mode performed by a user. The specific method for obtaining the application scenario of the voice does not affect the implementation of the embodiment of the present disclosure, and thus it is not limited herein.

The voice processing parameter is a guidance standard parameter for determining how to perform voice processing. It can be known by those skilled in the art that there may be many options for controlling the voice processing. A variation in system resources occupied by the voice processing which is caused by the various possible options can be predicted by those skilled in the art. A variation in voice quality which is caused by the various voice processing is also can be predicted by those skilled in the art. Based on the requirements of each application scenario on voice quality and on resource consumption, those skilled in the art can determine how to select the voice processing parameter.

In the above embodiments, the application scenarios of the voice which have different requirements on the voice quality correspond to different voice processing parameters, and a voice processing parameter adapted to the current application scenario of the voice is determined. An encoded voice packet is obtained by performing voice processing with the voice processing parameter adapted to the current application scenario of the voice, in this way, the solution of voice processing is adapt to the current application scenario of the voice, and thus system resources are saved while the requirement on the voice quality is met.

After the application scenario of the voice is obtained, the corresponding voice processing parameter is determined. The voice processing parameter may be pre-set locally. For example, the voice processing parameter may be stored in a form of a configuration table, which may be implemented as follows. Optionally, voice processing parameters corresponding to various application scenarios of the voice are pre-set in a device for processing the voice, and the various application scenarios of the voice correspond to different voice quality. The processor 680 being configured to configure the voice processing parameter corresponding to the application scenario of the voice includes: configuring the voice processing parameter corresponding to the application scenario of the voice based on pre-set voice processing parameters corresponding to various application scenarios of the voice.

It can be known by those skilled in the art that there may be many options for controlling the voice processing. A variation in system resources occupied by the voice processing which is caused by the various possible options can be predicted by those skilled in the art. A variation in voice quality which is caused by the various voice processing also can be predicted. In the embodiment of the present disclosure, the voice processing parameter preferably used for controlling decision is illustrated in the following. Optionally, the voice processing parameter configured by the processor 680 includes: at least one of a voice sample rate, an enable or disable state of acoustic echo cancellation, an enable or disable state of noise suppress, a noise attenuation intensity, an enable or disable state of automatic gain control, an enable or disable state of voice activity detection, the number of silence frames, a coding rate, a coding complexity, an enable or disable state of forward error correction, a network packet mode and a network packet transmitting mode.

For the process of performing voice processing on the acquired voice signal to obtain the encoded voice packet, a control parameter may be selected based on different requirements. Different control parameters correspond to different control flows. An optional solution is provided according to an embodiment of the present disclosure. It can be known by those skilled in the art that optional solutions are not exhaustively illustrated by the following examples, and the following examples should not be interpreted as limitation to the embodiments of the present disclosure. Optionally, the processor 681 being configured to perform voice processing on the acquired voice signal to obtain the encoded voice packet includes:

in a case that a background voice is currently enabled, determining whether the acquired voice signal is a voice inputted via a microphone; if the acquired voice signal is the voice inputted via the microphone, performing digital signal processing on a voice stream inputted via the microphone; and after the digital signal processing is finished, performing voice mixing with the background voice, voice encoding and packing to obtain the encoded voice packet; if the acquired voice signal is not the voice inputted via the microphone, performing voice mixing, voice encoding and packing after the voice is acquired, to obtain the encoded voice packet; and in a case that a background voice is not currently enabled, performing digital signal processing on the acquired voice signal, to obtain a voice frame; performing voice activity detection on the obtained voice frame to determine whether the obtained voice frame is a silence frame; and performing voice encoding and packing on a non-silence frame to obtain the encoded voice packet.

Optionally, the processor 680 is configured to perform the digital signal processing, including at least one of voice signal pre-processing, echo cancellation, noise suppress and automatic gain control.

The application scenario of the voice refers to the current application scenario for the voice processing. Hence, the application scenario of the voice may be various application scenarios in the field of computer technology to which the voice may be applied nowadays. It can be known by those skilled in the art that there are many application scenarios to which the voice can be applied nowadays, which can not be exhaustively listed in the embodiment of the present disclosure. Several representative application scenarios of the voice are illustrated in the embodiment of the present disclosure. Optionally, the above application scenario of the voice includes: at least one of a game scenario, a talk scenario, a high quality without video talk scenario, a high quality with live broadcast scenario or a high quality with video talk scenario, and a super quality with live broadcast scenario or a super quality with video talk scenario. Different application scenarios of the voice have different requirements on voice quality. For example, the game scenario has a low requirement on voice quality but a high requirement on currently occupied network speed, and requires less CPU (Central Processor Unit) resources for voice processing. The scenario relating live broadcast requires high fidelity and requires a special sound effect processing. A high quality mode requires more CPU resources and network traffic to ensure that the voice quality meets a requirement of the user. A variation in system resources occupied by the voice processing which is caused by the selection of parameter states of the voice processing parameters illustrated above can be predicted by those skilled in the art. A variation in voice quality which is caused by the various voice processing also can be predicted. Based on the various application scenarios illustrated in the above embodiments, a preferred solution for setting is provided according to an embodiment of the present disclosure. Specifically, the processor 680 is configured to: set the voice processing parameter for the game scenario as follows: the acoustic echo cancellation is enabled, the noise suppress is enabled, the noise attenuation intensity is high, the automatic gain control is enabled, the voice activity detection is enabled, the number of silence frames is large, the coding rate is low, the coding complexity is high, the forward error correction is enabled, the network packet mode is packing two voice frames in one encoded voice packet, and the network packet transmitting mode is single transmission;

set the voice processing parameter for the talk scenario as follows: the acoustic echo cancellation is enabled, the noise suppress is enabled, the noise attenuation intensity is low, the automatic gain control is enabled, the voice activity detection is enabled, the number of silence frames is small, the coding rate is low, the coding complexity is high, the forward error correction is enabled, the network packet mode is packing three voice frames in one encoded voice packet, and the network packet transmitting mode is single transmission;

set the voice processing parameter for the high quality without video talk scenario as follows: the acoustic echo cancellation is enabled, the noise suppress is enabled, the noise attenuation intensity is low, the automatic gain control is enabled, the voice activity detection is enabled, the number of silence frames is small, the coding rate is a default value, the coding complexity is a default value, the forward error correction is enabled, the network packet mode is packing one voice frame in one encoded voice packet, and the network packet transmitting mode is single transmission;

set the voice processing parameter for the high quality with live broadcast scenario or high quality with video talk scenario as follows: the acoustic echo cancellation is disabled, the noise suppress is disabled, the automatic gain control is disabled, the voice activity detection is disabled, the coding rate is a default value, the coding complexity is a default value, the forward error correction is enabled, the network packet mode is packing one voice frame in one encoded voice packet, and the network packet transmitting mode is double transmission; and set the voice processing parameter for the super quality with live broadcast scenario or super quality with video talk scenario as follows: the acoustic echo cancellation is disabled, the noise suppress is disabled, the automatic gain control is disabled, the voice activity detection is disabled, the coding rate is high, the coding complexity is a default value, the forward error correction is disabled, the network packet mode is packing one voice frame in one encoded voice packet, and the network packet transmitting mode is single transmission.

For controlling of the voice sample rate, the voice sample rate may be influenced by controlling the number of channels. In the embodiment of the present disclosure, the so-called multichannel includes two or more channels. The specific number of the channels is not limited in the embodiment of the disclosure. A preferred solution for setting the voice sample rate for different application scenarios is described as follows. Optionally, processor 680 is configured to set the voice sample rate for the game scenario and the talk scenario to be a single-channel and a low sample rate, and set the voice sample rate for the high quality without video talk scenario, the high quality with live broadcast scenario or high quality with video talk scenario, and the super quality with live broadcast scenario or super quality with video talk scenario to be a multichannel and a high sample rate.

It should be noted that, the division of the units according to the device embodiments of the present disclosure is merely based on logical functions, and the division is not limited to the above approach, as long as corresponding functions can be realized. In addition, names of the functional units are used to distinguish one from another and do not limit the protection scope of the present disclosure.

In addition, it can be understood by those skilled in the art that, all or some of the steps according to the method embodiments may be implemented by instructing related hardware with a program. The program may be stored in a computer readable storage medium. The storage medium may be a read-only memory, a magnetic disk or an optical disk, and so on.

The above are only preferred embodiments of the present disclosure, and the protection scope of the present disclosure is not limited hereto. Changes and substitutions, made by those skilled in the art without any creative efforts within the technical scope disclosed by the embodiments of the present disclosure, fall within the protection scope of the present disclosure. Therefore, the protection scope of the present disclosure should be defined by the protection scope of the claims.

The invention claimed is:

1. A method for processing an input voice signal in a network, comprising:

detecting a current application scenario for the input voice signal, a voice quality requirement and a network requirement associated with the current application scenario;

providing a setting comprising a background mode and a non-background mode;

when determining that the setting is in the background mode and determining that a source of the input voice signal is a microphone:

processing the input voice signal based on at least one of the voice quality requirement and the network requirement;

obtaining a background audio signal from an audio source separate from the microphone;

mixing the input voice signal and the background audio signal into a single mixed audio signal; and encoding the single mixed audio signal into one or more output audio packets based on at least one of the voice quality requirement and the network requirement;

when determining that the setting is in the non-background mode, detecting voice activity in the input voice signal, processing and encoding the input voice signal into the one or more output audio packets based on at least one of the voice quality requirement and the network requirement only when voice activity is detected; and transmitting the one or more output audio packets via the network.

2. The method according to claim 1, wherein processing and encoding the input voice signal comprises:

selecting voice processing and encoding parameter settings according at least one of the voice quality requirement and the network requirement; and processing and encoding the input voice signal using the selected voice processing and encoding parameter settings.

3. The method according to claim 2, wherein the detecting the current application scenario of the input voice signal comprises selecting an application scenario from a group of scenarios comprising:

a network game scenario;

a talk scenario;

a high quality without network video talk scenario;

a high quality with network live broadcast scenario or a high quality with network video talk scenario; and a super quality with network live broadcast scenario or a super quality with network video talk scenario.

4. The method according to claim 3, wherein the voice processing and encoding parameter settings correspond to parameters comprising at least one of:

a voice sample rate;

an enable or disable state of acoustic echo cancellation;

an enable or disable state of noise suppression;

a noise attenuation intensity;

an enable or disable state of automatic gain control;

an enable or disable state of voice activity detection';

a number of silence frames;

a coding rate;

a coding complexity;

an enable or disable state of forward error correction;

a network packet mode; and a network packet transmitting mode.

5. The method according to claim 4, wherein:

the selected voice processing and encoding parameter settings for a game scenario comprises an enabled acoustic echo cancellation setting, an enabled noise suppression setting, a high noise attenuation setting, an enabled automatic gain control setting, an enabled voice activity detection setting, a large number of silence frames setting, a low coding rate setting, a high coding complexity setting, an enabled forward error correction setting, a two voice frames per encoded voice packet setting, and a single transmission network packet transmitting setting;

the selected voice processing and encoding parameter settings for a talk scenario comprises an enabled acoustic echo cancellation setting, an enabled noise suppression setting, a low noise attenuation setting, an enabled automatic gain control setting, an enabled voice activity detection setting, a small number of silence frames setting, a low coding rate setting, a high coding complexity setting, an enabled forward error correction setting, a three voice frames per encoded voice packet setting, and a single transmission network packet transmitting setting;

the selected voice processing and encoding parameter settings for a high quality without video talk scenario comprises an enabled acoustic echo cancellation setting, an enabled noise suppression setting, a low noise attenuation setting, an enabled automatic gain control setting, an enabled voice activity detection setting, a small number of silence frames setting, a default coding rate setting, a default coding complexity setting, an enabled forward error correction setting, a one voice frames per encoded voice packet setting, and a single transmission network packet transmitting setting;

the selected voice processing and encoding parameter settings for a high quality with live broadcast scenario or a high quality with video talk scenario comprises a disabled acoustic echo cancellation setting, a disabled noise suppression setting, a disabled automatic gain control setting, a disabled voice activity detection setting, a default coding rate setting, a default coding complexity setting, an enabled forward error correction setting, a one voice frames per encoded voice packet setting, and a double transmission network packet transmitting setting; and the selected voice processing and encoding parameter settings for a super quality with live broadcast scenario or a super quality with video talk scenario comprises a disabled acoustic echo cancellation setting, a disabled noise suppression setting, a disabled automatic gain control setting, a disabled voice activity detection setting, a high coding rate setting, a default coding complexity setting, a disabled forward error correction setting, a one voice frames per encoded voice packet setting, and a single transmission network packet transmitting setting.

6. The method according to claim 2, wherein the voice processing and encoding parameter settings correspond to parameters comprising at least one of:

a voice sample rate;

an enable or disable state of acoustic echo cancellation;

an enable or disable state of noise suppression;

a noise attenuation intensity;

an enable or disable state of automatic gain control;

an enable or disable state of voice activity detection';

a number of silence frames;

a coding rate;

a coding complexity;

an enable or disable state of forward error correction;

a network packet mode; and a network packet transmitting mode.

7. The method according to claim 2, wherein the processing of the input voice signal comprises at least one of:

voice signal pre-processing;

echo cancellation;

noise suppression; and automatic gain control.

8. The method according to claim 1, further comprising:

when determining that the setting is in the background mode and determining that a source of the input voice signal is not a microphone:

obtaining the background audio signal;

mixing the input voice signal and the background audio signal into the single mixed audio signal without processing the input voice signal based on at least one of the voice quality requirement and the network requirement; and encoding the single mixed audio signal into the one or more output audio packets based on at least one of the voice quality requirement and the network requirement.

9. The method according to claim 1, wherein when the source of the input voice signal is the microphone, channel characteristics of the input voice signal is determined by the current application scenario.

10. The method according to claim 9, the channel characteristics of the input voice signal comprises one of a single channel characteristics and a multi-channel characteristics.

11. A device for processing an input voice signal in a network, comprising:

a memory for storing instructions;

one or more processors in communication with the memory, the one or more processors, when executing the instructions, are configured to:

detect a current application scenario for the input voice signal, a voice quality requirement and a network requirement associated with the current application scenario;

provide a setting comprising a background mode and a non-background mode;

when determining that the setting is in the background mode and determining that a source of the input voice signal is a microphone:

process the input voice signal based on at least one of the voice quality requirement and the network requirement;

obtain a background audio signal from an audio source separate from the microphone;

mix the input voice signal and the background audio signal into a single mixed audio signal; and encode the single mixed audio signal into one or more output audio packets based on at least one of the voice quality requirement and the network requirement;

when determining that the setting is in the non-background mode, detect voice activity in the input voice signal, process and encode the input voice signal into the one or more output audio packets based on at least one of the voice quality requirement and the network requirement only when voice activity is detected; and transmit the one or more output audio packets via the network.

12. The device according to claim 11, wherein the one or more processors, when executing the instructions to process and encode the input voice signal, is configure to:

select voice processing and encoding parameter settings according at least one of the voice quality requirement and the network requirement; and process and encode the input voice signal using the selected voice processing and encoding parameter settings.

13. The device according to claim 12, wherein to detect the current application scenario of the input voice signal comprises to select an application scenario from a group of scenarios comprising:

a network game scenario;

a talk scenario;

a high quality without network video talk scenario;

a high quality with network live broadcast scenario or a high quality with network video talk scenario; and a super quality with network live broadcast scenario or a super quality with network video talk scenario.

14. The device according to claim 13, wherein the voice processing and encoding parameter settings correspond to parameters comprising at least one of:

a voice sample rate;

an enable or disable state of acoustic echo cancellation;

an enable or disable state of noise suppression;

a noise attenuation intensity;

an enable or disable state of automatic gain control;

an enable or disable state of voice activity detection';

a number of silence frames;

a coding rate;

a coding complexity;

an enable or disable state of forward error correction;

a network packet mode; and a network packet transmitting mode.

15. The device according to claim 14, wherein:

the selected voice processing and encoding parameter settings for a game scenario comprises an enabled acoustic echo cancellation setting, an enabled noise suppression setting, a high noise attenuation setting, an enabled automatic gain control setting, an enabled voice activity detection setting, a large number of silence frames setting, a low coding rate setting, a high coding complexity setting, an enabled forward error correction setting, a two voice frames per encoded voice packet setting, and a single transmission network packet transmitting setting;

the selected voice processing and encoding parameter settings for a talk scenario comprises an enabled acoustic echo cancellation setting, an enabled noise suppression setting, a low noise attenuation setting, an enabled automatic gain control setting, an enabled voice activity detection setting, a small number of silence frames setting, a low coding rate setting, a high coding complexity setting, an enabled forward error correction setting, a three voice frames per encoded voice packet setting, and a single transmission network packet transmitting setting;

the selected voice processing and encoding parameter settings for a high quality without video talk scenario comprises an enabled acoustic echo cancellation setting, an enabled noise suppression setting, a low noise attenuation setting, an enabled automatic gain control setting, an enabled voice activity detection setting, a small number of silence frames setting, a default coding rate setting, a default coding complexity setting, an enabled forward error correction setting, a one voice frames per encoded voice packet setting, and a single transmission network packet transmitting setting;

the selected voice processing and encoding parameter settings for a high quality with live broadcast scenario or a high quality with video talk scenario comprises a disabled acoustic echo cancellation setting, a disabled noise suppression setting, a disabled automatic gain control setting, a disabled voice activity detection setting, a default coding rate setting, a default coding complexity setting, an enabled forward error correction setting, a one voice frames per encoded voice packet setting, and a double transmission network packet transmitting setting; and the selected voice processing and encoding parameter settings for a super quality with live broadcast scenario or a super quality with video talk scenario comprises a disabled acoustic echo cancellation setting, a disabled noise suppression setting, a disabled automatic gain control setting, a disabled voice activity detection setting, a high coding rate setting, a default coding complexity setting, a disabled forward error correction setting, a one voice frames per encoded voice packet setting, and a single transmission network packet transmitting setting.

16. The device according to claim 12, wherein the voice processing and encoding parameter settings corresponds to parameters comprising at least one of:

a voice sample rate;

an enable or disable state of acoustic echo cancellation;

an enable or disable state of noise suppression;

a noise attenuation intensity;

an enable or disable state of automatic gain control;

an enable or disable state of voice activity detection';

a number of silence frames;

a coding rate;

a coding complexity;

an enable or disable state of forward error correction;

a network packet mode; and a network packet transmitting mode.

17. The device according to claim 12, wherein to process the input voice signal comprises at least one of:

voice signal pre-processing;

echo cancellation;

noise suppression; and automatic gain control.

18. The device according to claim 11, further the one or more processors, when executing the instructions, are further configured to:

when determining that the setting is in the background mode and determining that a source of the input voice signal is not a microphone:

obtain the background audio signal;

mix the input voice signal and the background audio signal into the single mixed audio signal without processing the input voice signal based on at least one of the voice quality requirement and the network requirement; and encode the single mixed audio signal into the one or more output audio packets based on at least one of the voice quality requirement and the network requirement.

19. The device according to claim 11, wherein when the source of the input voice signal is the microphone, channel characteristics of the input voice signal is determined by the current application scenario.

20. A non-transitory computer-readable storage medium for storing instructions, the instructions, when executed by one or more processors, are configured to cause the one or more processors to:

detect a current application scenario for an input voice signal, a voice quality requirement and a network requirement associated with the current application scenario;

provide a setting comprising a background mode and a non-background mode;

when determining that the setting is in the background mode and determining that a source of the input voice signal is a microphone:

process the input voice signal based on at least one of the voice quality requirement and the network requirement;

obtain a background audio signal from an audio source separate from the microphone;

mix the input voice signal and the background audio signal into a single mixed audio signal; and encode the single mixed audio signal into one or more output audio packets based on at least one of the voice quality requirement and the network requirement;

when determining that the setting is in the non-background mode, detect voice activity in the input voice signal, process and encode the input voice signal into the one or more output audio packets based on at least one of the voice quality requirement and the network requirement only when voice activity is detected; and transmit the one or more output audio packets via a network.

* * * * *